US007316464B2

(12) United States Patent
Shibata et al.

(10) Patent No.: US 7,316,464 B2
(45) Date of Patent: Jan. 8, 2008

(54) INK JET PRINT APPARATUS AND INK JET PRINT METHOD

(75) Inventors: Tsuyoshi Shibata, Kanagawa (JP); Noribumi Koitabashi, Kanagawa (JP); Masataka Yashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 10/864,316

(22) Filed: Jun. 10, 2004

(65) Prior Publication Data

US 2004/0252148 A1 Dec. 16, 2004

(30) Foreign Application Priority Data

Jun. 16, 2003 (JP) ..... 2003-171325

(51) Int. Cl.
*B41J 29/38* (2006.01)

(52) U.S. Cl. ..... 347/14; 347/19

(58) Field of Classification Search ..... 347/12, 347/15, 19, 14

See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 6,481,816 | B1 * | 11/2002 | Oyen | 347/12 |
| 6,565,180 | B2 | 5/2003 | Yu et al. | |
| 6,779,865 | B2 | 8/2004 | Shibata et al. | |
| 2002/0054179 | A1 * | 5/2002 | Shibata et al. | 347/15 |
| 2002/0135653 | A1 * | 9/2002 | Otsuki | 347/104 |
| 2003/0086100 | A1 | 5/2003 | Yashima et al. | |
| 2004/0104951 | A1 | 6/2004 | Shibata et al. | |
| 2004/0119766 | A1 * | 6/2004 | Shibata et al. | 347/12 |

FOREIGN PATENT DOCUMENTS

| | | |
|---|---|---|
| JP | 59-123670 | 7/1984 |
| JP | 59-138461 | 8/1984 |
| JP | 2002-067297 | 3/2002 |

* cited by examiner

*Primary Examiner*—Julian D. Huffman
*Assistant Examiner*—Jason Uhlenhake
(74) *Attorney, Agent, or Firm*—Fitzpatrick, Cella, Harper & Scinto

(57) ABSTRACT

In an image area printed by a nozzle group including a defective nozzle, pixels printed by the defective nozzle and part of pixels located in the vicinity of the same are printed by another nozzle group. As a result, since printing is performed not only at the pixels printed by the defective nozzle but also at the pixels in the neighborhood thereof simultaneously by separate nozzles, irregularities of printing attributable to interpolation are distributed even when there is a relative misalignment between the nozzle groups. It is therefore possible to obtain a preferable image without any increase in output time even when a printing head including a defective nozzle is used.

8 Claims, 13 Drawing Sheets

INK JET PRINT APPARATUS AND INK JET PRINT METHOD

This application claims priority from Japanese Patent Application No. 2003-171325 filed Jun. 16, 2003, which is incorporated hereinto by reference.

BACKGROUND OF THE INVENTION

1. Field of the Invention

The present invention relates to an ink jet print apparatus and print method with which a higher printing speed can be achieved while eliminating an irregularity of an image caused by an ejection failure at a nozzle.

2. Description of the Related Art

Recently, a variety of print apparatus employing the ink jet method are provided in fields of application such as printers, facsimile machines, and copying machines. In particular, color ink jet print apparatus for printing color images using inks in a plurality of colors are rapidly spreading because of high quality images rendered by them.

Such ink jet printing can be primarily categorized into serial type printing and line type printing. In serial type printing, an image is formed by alternately repeating printing main scans in which printing is performed by scanning a printing head having a plurality of printing elements on a printing medium and sub-scans in which the printing medium is transported in a direction crossing the direction of the printing main scans. Thus, serial type apparatus are suitable for personal use and are therefore available on the market in a great variety because they are relatively small-sized and inexpensive. In the case of a line type print apparatus, a long printing head having printing elements in a quantity to cover a printing width on a printing medium is used, and an image is completed by moving the printing medium relative to the printing elements in a direction different from the direction in which the printing elements are arranged. Therefore, line type print apparatus are frequently expensive and large-sized because their printing heads are long. However, they can perform better than serial type print apparatus in terms of printing speed.

While images in high definition and high quality are expected from ink jet print apparatus as described above another important factor is an increase in speed in order to complete printing in a shorter time. It is effective to increase an ejection driving frequency for droplets ejected from each printing element in increasing the speed of an ink jet print apparatus, and increasing the number of printing elements is also an effective approach especially for a serial printer.

When the number of printing elements is increased, it is desired that no failure occurs at any of the nozzles. When a printing head is manufactured, however, some defective nozzles are inevitably generated Defective nozzles are nozzles which significantly reduce the quality of an image, e.g., nozzles which generate a white line in a printed image. Defective nozzles include not only nozzles that are completely disabled from ejecting but also nozzles whose ink droplets ejecting direction is greatly deflected from a predetermined direction (hereinafter referred to as "deflection") and nozzles which eject ink droplets in a quantity that is greatly different from a desired quantity (hereinafter referred to as "ejection quantity variation"). As described above, such defective nozzles are generated at a certain probability. Therefore, a problem has arisen in that the yield of printing heads is lower, the greater the number of nozzles of the printing heads manufactured.

A countermeasure referred to as "ejection failure interpolation" has already been proposed for the above-described problem. "Ejection failure interpolation" is a method in which a line to be printed by a defective nozzle is interpolated using another nozzle which prints the same line. Thus, even when there are some defective nozzles on a printing head, an image can be printed with a certain degree of normality maintained. A brief description will now be made on ejection failure interpolation according to the related art.

FIGS. 1A, 1B and 1C show a state of printing in which a desired image in the same region is formed by two groups of nozzles (101 and 102) of different types FIG. 1A shows input image data for a region printed by the nozzle group 101. Each of the grids represents a pixel having multi-valued density information, and it is assumed here that density data on the order of 25% are supplied to all of the pixels. FIG. 1B shows input image data for a region printed by the nozzle group 102, and density data on the order of 25% are supplied to all of the printed pixels.

The nozzle groups 101 and 102 may be different nozzle groups which eject an ink in the same color, and they may alternatively be nozzle groups on different printing heads which eject inks in different colors. The print apparatus may be a serial type apparatus which performs printing while moving the nozzle groups 101 and 102 to the left and right, and it may be a line type apparatus which performs printing while transporting a printing medium to the left or right.

The image data shown in FIGS. 1A and 1B are thereafter processed into a binary form and are printed by the respective nozzle group 101 and 102. As a result, as shown in FIG. 1C, a uniform image having a density of about 50% is formed on paper.

FIGS. 2A, 2B, and 2C shows a method for performing ejection failure interpolation for an image when one nozzle 101*a* among the nozzle group 101 shown in FIG. 1A has an ejection failure. The nozzle 101*a* is disabled for ejection or has a defect such as "deflection" or "ejection quantity variation" even though it is enabled for ejection. Therefore, as shown in FIG. 2A, all image data in positions associated with the defective nozzle 101*a* are "0" (in a non-printing state). For a nozzle 102*a* which performs printing in the same position as the nozzle 101*a*, as shown in FIG. 2B, image data having a value higher (25% higher) than a value in other regions printed by the nozzle group 102 are supplied. The image data shown in FIGS. 2A and 2B are processed into a binary form and are thereafter printed by the respective nozzle groups 101 and 102. As a result, a uniform image having a density of about 50% is formed on paper as shown in FIG. 2C.

No image defect attributable to the nozzle 101*a* having an ejection failure is observed on the image thus completed. It is thus possible to obtain an output image having no visible white line attributable to ejection failure which is substantially similar to the image shown in FIG. 1C printed with a printing head having no ejection failure.

Ejection failure interpolation as described above has allowed printing to be continued without any increase in output time even if there are some defective nozzles whether the apparatus is a serial type or line type.

Ejection failure interpolation according to the above-described method has problems as described below, and it has provided only insufficient results.

FIGS. 3A, 3B, and 3C show a state of printing achieved by an ejection failure interpolation process according to the above-described method performed on image data having a density of 25% printed by each of a nozzle group 101 including a defective nozzle 101*a* and a nozzle group 102.

It is assumed here that a nozzle 102*a* for performing interpolation for the defective nozzle 101*a* has some "deflection". In this case, since the nozzle 102*a* cannot properly fill a white line even if it performs printing for interpolation as shown in FIG. 3B, the white line appears on an image as shown in FIG. 3C. Further, the ink is deposited in an amount greater than that required in a region adjacent to the white line, and the region appears as a black line as illustrated. Therefore, the image defect that appears on the output image may be more striking than that in a case wherein no interpolation is performed.

When interpolation is mutually performed between the different nozzle groups, there is a good possibility of some misalignment of a nozzle which performs interpolation from a nozzle for which the interpolation is performed, as thus described. Every nozzle has some variation in directivity. Further, a relative misalignment not only occurs at one nozzle but also occurs between the nozzle group 101 and the nozzle group 102 in not a few cases.

Further, even when there is no misalignment between the nozzle groups 101 and 102 as shown in FIGS. 2A, 2B, and 2C, in a case wherein the nozzle groups perform printing in different ink colors, a line for which interpolation for a defective nozzle has been performed can appear in a striking manner in a color tint different from that in other regions.

The ejection failure interpolation is a process which is performed to make an image defect attributable to ejection failure less noticeable. However, according to the above-described method in the related art, an interpolated portion becomes more noticeable contrary to the intention in not a few cases. That is, the ejection failure interpolation process in the related art has been insufficient to achieve effects expected from the same.

SUMMARY OF THE INVENTION

The invention has been made to solve the above-described problems, and it is an object of the invention to provide a method of printing in which any irregularity in an image attributable to a defective nozzle or a nozzle for performing interpolation for that nozzle can be prevented without increasing an outputting time even when a printing head including a defective nozzle is used.

In a first aspect of the present invention, there is provided an ink jet print apparatus for printing an image using a printing head having a plurality of nozzle groups that are arrays of a plurality of nozzles for ejecting a liquid, the apparatus comprising; correction means which corrects an image printed by a nozzle in a defective ejecting condition included in at least one of the plurality of nozzle groups using one or more nozzle groups with no nozzle in a defective ejecting condition among the plurality of nozzle groups, wherein the correction means corrects the image at pixels printed by the nozzle in a defective ejecting condition and pixels in the vicinity of the pixels.

In a second aspect of the present invention there is provided an ink jet print method in which a plurality of nozzle groups that are arrays of a plurality of nozzles for ejecting a liquid are provided and a predetermined image is printed using the plurality of nozzle groups, the method comprising the step of: correcting an image printed by a nozzle in a defective ejecting condition included in at least one of the plurality of nozzle groups using one or more nozzle groups with no nozzle in a defective ejecting condition among the plurality of nozzle groups, the step correcting the image at pixels printed by the nozzle in a defective ejecting condition and pixels in the vicinity of the pixels.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the invention will now be described in detail with reference to the drawings.

Figure 4:
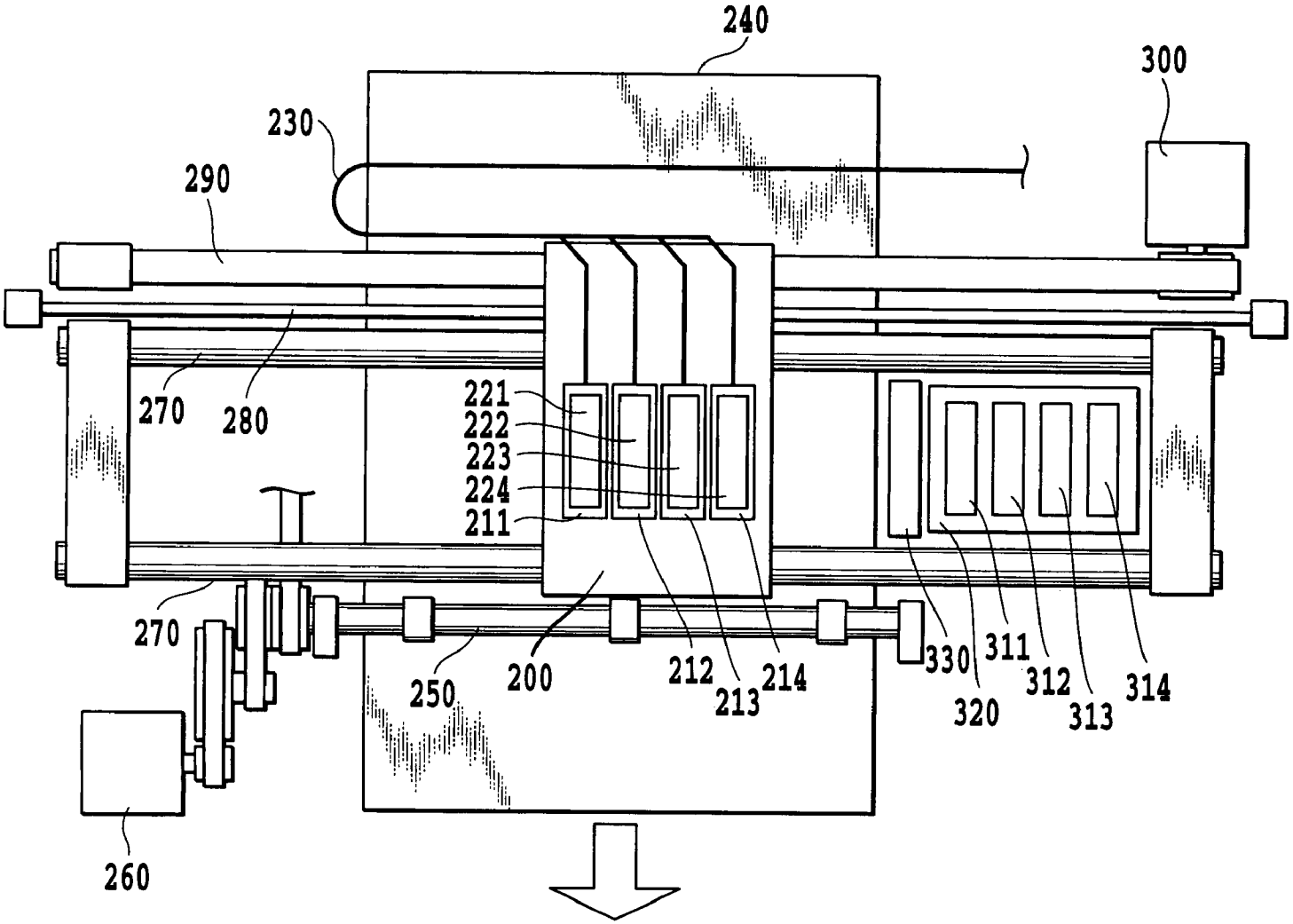
FIG. 4 is a schematic configuration diagram of a serial type ink jet print apparatus to which an embodiment of the invention can be applied.

FIG. 4 is a schematic configuration diagram of a serial type ink jet print apparatus to which an embodiment of the invention can be applied. In FIG. 4, reference numerals 211 to 214 represent printing heads on which a plurality of ink ejection holes for ejecting ink and a plurality of electrothermal transducers for generating thermal energy for ejecting ink are arranged. Reference numerals 221 to 224 represent ink tanks which contain black (Bk), cyan (C), magenta (M), and yellow (Y) inks and which supply the inks to the printing heads 211 to 214, respectively. The printing heads 211 to 214 and the ink tanks 221 to 224 are integrated to configure a cartridge. A carriage 200 is moved and scanned to the left and right in the figure with the cartridge mounted thereon.

The movement and scanning of the carriage 200 is driven by a carriage motor 300 through a drive belt 290 cooperating with the same under guidance and support provided by a guide shaft 270 and a linear encoder 280. At this time, as the carriage 200 is moved, timing for driving the printing elements is read from the linear encoder 280. Drive signals are transmitted to the electrothermal transducers in the printing heads 211 to 214 according to the timing.

The plurality of electrothermal transducers provided at the printing heads 211 to 214 are rapidly overheated according to the drive signals to cause foaming in the inks in contact with them. The inks are ejected in the form of ink droplets flying from the ink ejection holes in a quantity in accordance with a volumetric expansion attributable to the foaming.

Control signals including such drive signals to the printing heads 211 to 214 are transmitted through a flexible cable 230.

Types of usable printing media include plain paper, dedicated paper suitable for obtaining images printed in high quality, OHP sheets, glossy paper, glossy films, and postcards. A printing medium 240 is driven by a conveying motor 260 to be fed in the direction indicated by the arrow (a sub-scanning direction) through a conveying roller which is not shown, the medium being sandwiched by paper discharge rollers 250.

A home position of the carriage 200 is located outside a printing area. A recovery unit 320 having cap portions 311 to 314 associated with respective colors is provided in the home position. When no printing is performed by the printing heads 211 to 214, the carriage 200 is moved to the home position in which the caps 311 to 314 seal surfaces of the respective printing heads 211 to 214 where the ink ejecting holes are provided. This makes it possible to prevent clogging attributable to sticking of ink caused by evaporation of the ink solvent from the ejection holes or attributable to deposition of foreign substances such as dust. The cap portions 311 to 314 are also used for receiving evacuative ejection that is ejection of ink to eliminate any ejection failure or clogging of nozzles which are less frequently used for printing. Furthermore, a cap is used for a process of recovering an ejection hole having an ejection failure by absorbing ink from the ejection hole by operating a pump which is not shown while capping the hole.

Reference numeral 330 represents an ink receiving portion. The printing heads 211 to 214 perform preparatory ejection while passing above the ink receiving portion 330 immediately before they are scanned for printing. The ink receiving portion 330 receives the ejected ink. A blade as a wiping member is provided in a position adjacent to the caps 311 to 314 to allow cleaning of the surfaces of the printing heads 211 to 214 where the ejection holes are formed.

When ejection failure interpolation is performed in such a serial type ink jet print apparatus, a substitute nozzle which compensates for an image formed by a defective nozzle may be a nozzle of any color that prints the same line as the defective nozzle.

Each of the printing heads 211 to 214 may be equipped with two rows of nozzles and may have a configuration in which the two rows of nozzles print the same line such that they interpolate each other.

In a serial type print apparatus, a multi-pass print method may be implemented in order to obtain an image in high quality. According to the multi-pass printing method, a plurality of printing scans are performed in the same image region to form an image, conveyance of the printing medium being performed between the printing scans. When such multi-pass printing is performed, a nozzle which is provided on the same printing head having a defective nozzle and which prints the same line as the defective nozzle in a different printing scan may be used as a substitute nozzle for ejection failure interpolation The present embodiment may be applied not only to a serial type print apparatus as described above but also to a line type print apparatus as described below.

Figure 5:
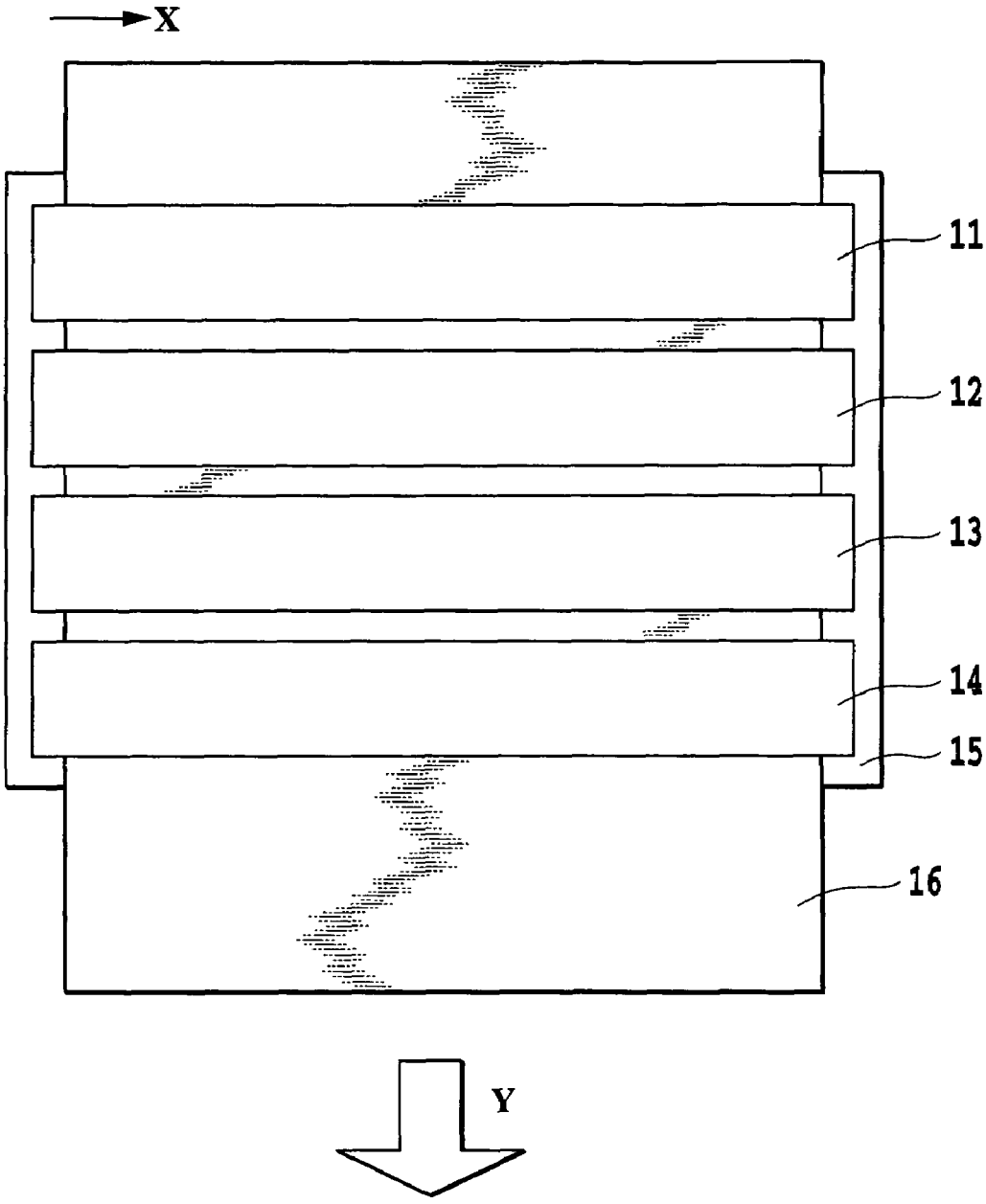
FIG. 5 is a schematic configuration diagram of a line type ink jet print apparatus to which an embodiment of the invention can be applied.

FIG. 5 is a schematic configuration diagram of a line type ink jet print apparatus to which the present embodiment can be applied.

In FIG. 5, reference numerals 11 to 14 represent printing heads. The printing heads 11 to 14 are long parts having a width equivalent to a printing width of a printing medium 16. Printing heads 11, 12, 13, and 14 eject black (Bk), cyan (C), magenta (M), and yellow (Y) inks, respectively, and they are integrally formed on a head unit 15.

A plurality of ejection holes for ejecting respective inks are arranged on the printing heads 11 to 14 in the direction indicated by X in the figure. In the present embodiment, the ejection holes for each color arranged in the X direction may be a row of couples of ejection holes which are in parallel with each other in the direction indicated by Y. In such a configuration, a line printed by ejection holes and extending in the Y direction can be formed by two ejection holes Therefore, variation of printing unique to each of the ejection holes can be distributed as seen in serial type multi-pass printing. When an ejection failure occurs, an ejection failure interpolation process can be performed to allow the two ejection holes to compensate for each other. However, such a nozzle arrangement or configuration does not limit the present embodiment. In the case of a printing head having one row of ejection holes for each color, when there is a defective nozzle, a nozzle of a color different printing the same line as the defective nozzle may be used as a substitute nozzle for correction.

Electrothermal transducers for generating thermal energy used for ejection of ink are provided in the ejection holes (liquid channels) of the printing heads 11 to 14. The electrothermal transducers are driven based on printing signals transferred through a flexible cable. Foaming occurs in ink in contact with the electrothermal transducers which are thus rapidly overheated, and ink droplets in a quantity in accordance with a volumetric expansion as a result of the foaming fly from the ejection holes. Ink is thus ejected.

Tubes are connected to the printing heads 11 to 14 to supply the respective inks. Ink is continuously supplied to a printing head at which ejection takes place.

A printing medium 16 is sandwiched by conveying rollers and paper discharge rollers which are not shown to be conveyed in the Y direction (main scanning direction) as a conveying motor is driven. When no printing is performed, surfaces of the printing heads 11 to 14 where ink ejection holes are provided are sealed with capping means which is not shown. This makes it possible to suppress clogging attributable to sticking of ink caused by evaporation of the ink solvent or attributable to deposition of foreign substances such as dust. The capping means is also used for receiving evacuative ejection that is ejection of ink from the ejection holes to eliminate any ejection failure or clogging of nozzles which are less frequently used for printing. Furthermore, the capping means is used for a process of recovering an ejection hole having an ejection failure by absorbing ink from the ejection hole by operating a pump which is not shown while capping the hole.

A blade or wiping member may be provided in a position adjacent to the capping means to allow cleaning of the surfaces of the printing heads 11 to 14 where the ejection holes are formed.

Figure 6:
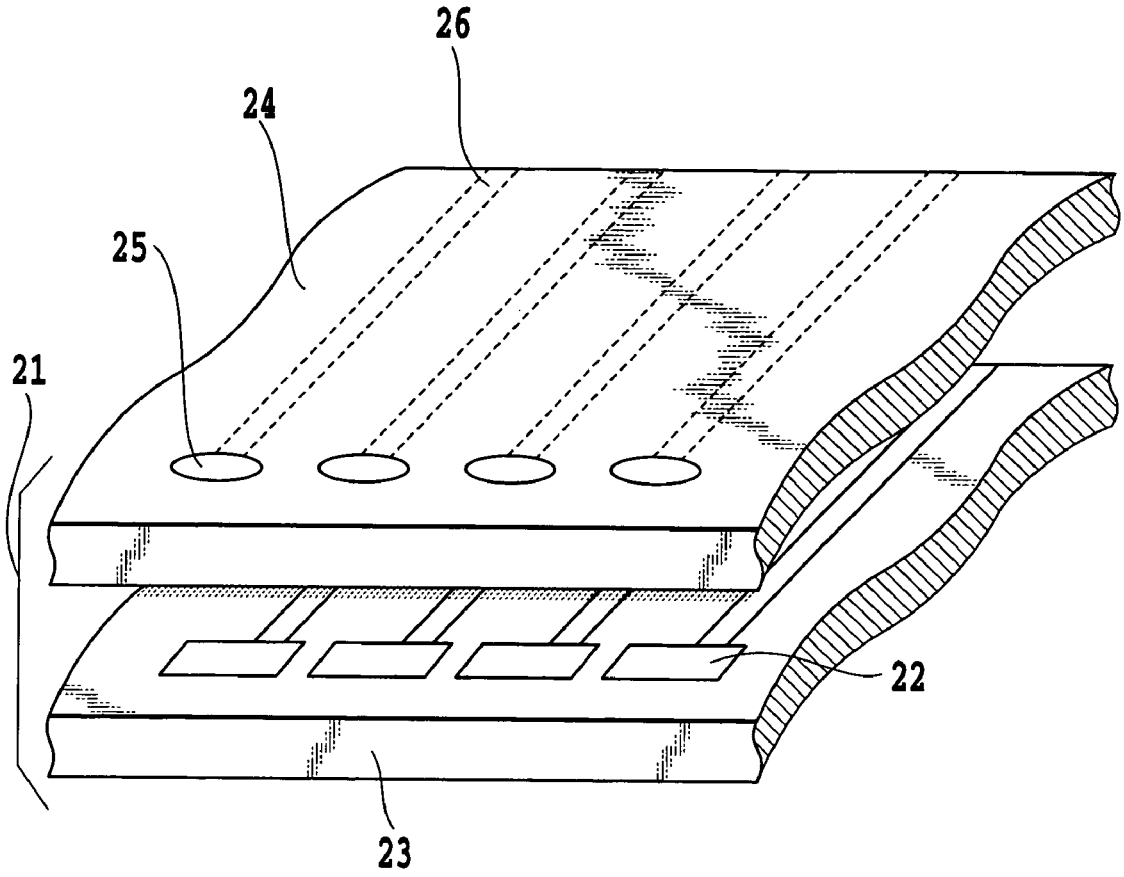
FIG. 6 is a schematic view for explaining a configuration of a printing head to which an embodiment of the invention can be applied.

FIG. 6 is an exploded perspective view for explaining a structure of a printing element in any of printing heads 211 to 214 shown in FIG. 4 or printing heads 21 to 14 shown in FIG. 5. In FIG. 6, a printing head 21 is generally constituted by a heater board 23 on which a plurality of electrothermal transducers 22 are formed and a top plate 24 which covers the heater board 23 from above the same in the figure and which forms ink channels. A plurality of ejection holes 25 are formed on the top plate 24, and channels 26 in the form of tunnels are formed behind the ejection holes 25 in communication with the ejection holes 25. The channels 26 are commonly routed into one ink chamber at the other ends thereof, and ink is supplied to the ink chamber through an ink supply hole and an ink tube.

The heater board 23 and the top plate 24 are assembled such that the plurality of electrothermal transducers 22 are disposed in positions associated with the respective ones of the plurality of channels 26.

Figure 7:
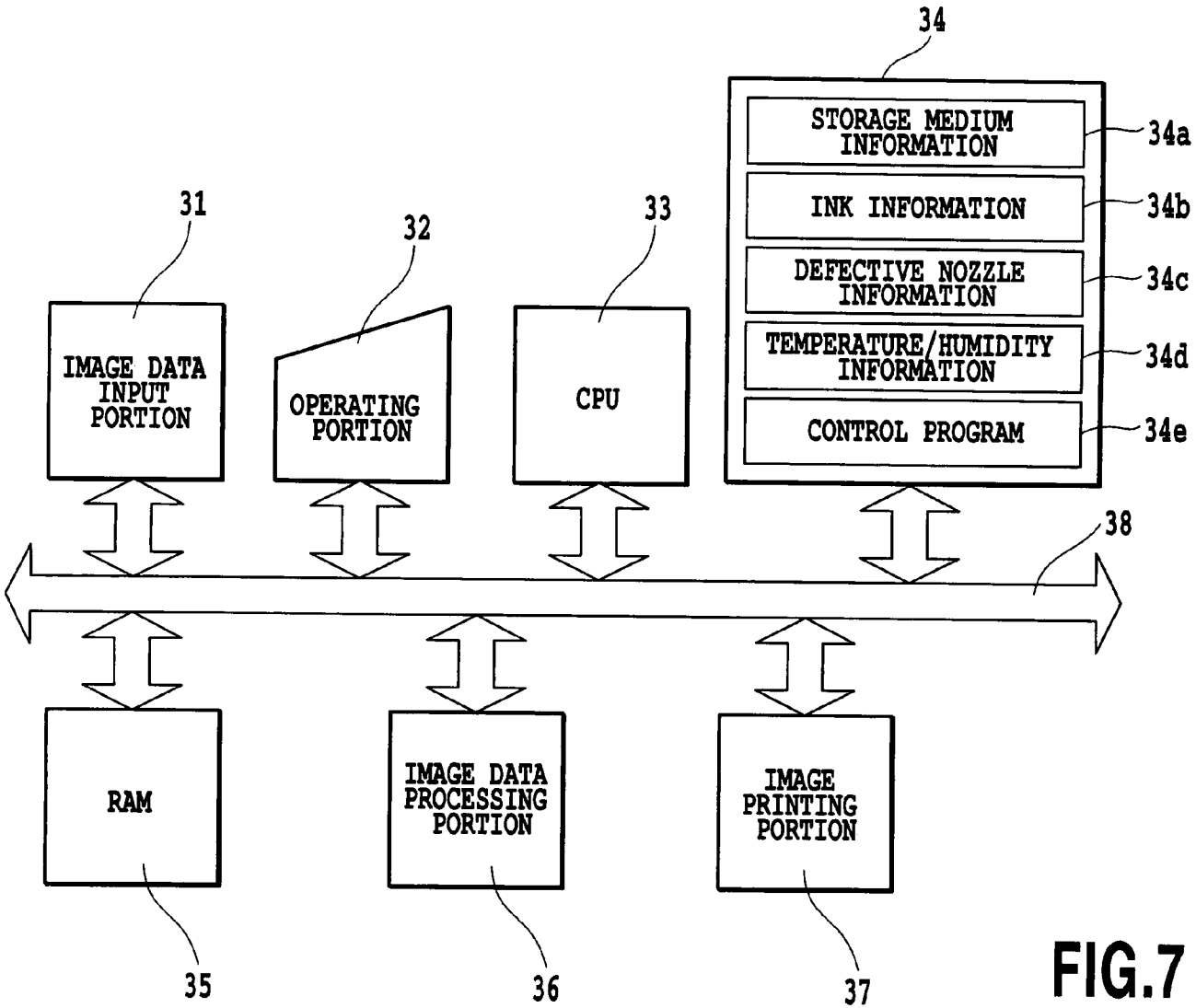
FIG. 7 is a block diagram for explaining a configuration of a control system to which an embodiment of the invention can be applied.

FIG. 7 is a block diagram for explaining a configuration of a control system of an ink jet print apparatus to which the present embodiment can be applied In FIG. 7, reference numeral 31 represents an image data input portion. The image data input portion 31 is means for inputting image data to the print apparatus, the image data including image data input from a scanner or digital camera and image data stored in a hard disk of a personal computer. Reference numeral 32 represents an operating portion which has various keys to allow an operator to set various parameters and to instruct commencement of printing. Reference numeral 33 is a central processing unit (CPU) which controls the print apparatus as a whole according to a program in a storage medium 34. Stored in the storage medium 34 are information 34*a* on the types of printing media, information 34*b* on ink, information 34*c* on the presence and position of any defective nozzle, information 34*d* on the environment such as the temperature and humidity at the time of printing, and various control programs 34*e*. A ROM, floppy disk, CD-ROM, hard disk, memory card, or magneto-optical disk may be used as the storage medium 34

Reference numeral 35 represents a RAM. The RAM 35 is used as a work area when various programs stored in the storage medium 34 are executed or an area for saving required data at the time of error processing. Further, various data stored in the storage medium 34 may be temporarily copied into the RAM 35. The CPU 33 can perform image processing by changing the contents of data in the storage medium 34 or referring to the data thus changed with a copy of the data before the change maintained in the RAM 35.

Reference numeral 36 is an image data processing portion. The image data processing portion 36 performs a quantization process on multi-valued image data input from the image data input portion 31 to covert it into ejection data which can be printed by the printing heads. For example, when data input from the image data input portion 31 is multi-valued data represented by eight bits (256 gradations), the image data processing portion 36 converts it into data at a lower level, e.g., data in 25 gradations. While the commonly known multi-valued error diffusion method may be used for the quantization, any method for halftone processing such as the average density preservation method or dither matrix method may alternatively be used. Further, the image data processing portion 36 converts the quantized data of 25 gradations into ejection data which can be printed by the printing heads. When the printing heads are capable of printing based on only two items of information, i.e. , "ejections" and "no ejection", the data is converted into binary data according to a pattern in which items of data are defined as either "printing" or "no printing". When the quantity of ink ejected by the printing heads can be controlled at a plurality of steps, the number of data levels is reduced to the number of the printable steps.

Reference numeral 37 represents an image printing portion for outputting an image. At the image printing portion 37, pulses for driving the printing heads are generated according to ejection data created by the image data processing portion 36 to eject ink from each of the ejection holes of the printing heads.

Reference numeral 38 represents a bus for transferring various data. Address signals, data, and control signals in the print apparatus are transferred over the bus 38.

Methods of interpolating an image to be printed by a defective nozzle characteristic of the invention will now be described by referring to, by way of example, several embodiments of the same in which a serial type or line type ink jet print apparatus as described with reference to FIGS. 4 to 7 is used.

First Embodiment

Figure 3A:
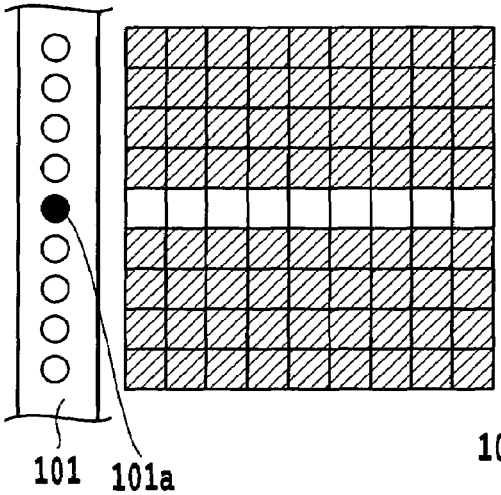
FIGS. 3A to 3C are illustrations for explaining a problem that occurs when the ejection failure interpolation process is performed according to the method in the related art.
Figures 8A, 8B:
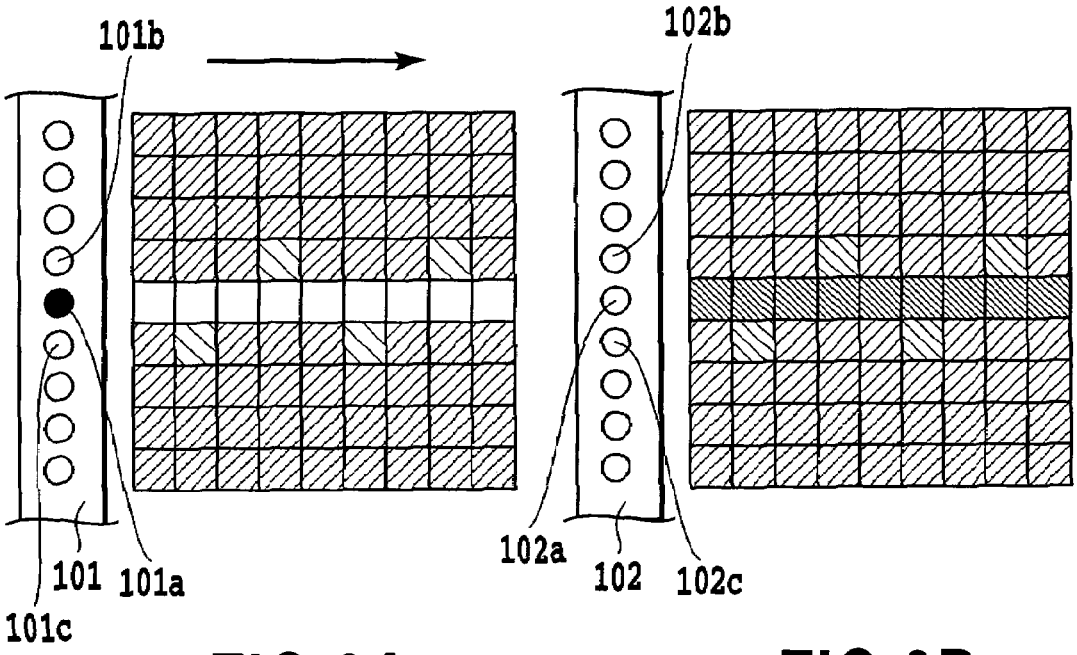
FIGS. 8A to 8C are illustrations for explaining an ejection failure interpolation process in a first embodiment of the invention.
Figure 8C:
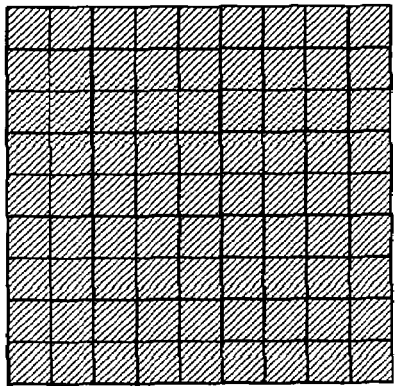

FIGS. 8A, 8B, and 8C are illustrations for explaining a method of interpolation in a first embodiment of the invention. Similarly to FIGS. 3A, 3B, and 3C, FIGS. BA, 8B, and 8C show a state of printing achieved when an election failure interpolation process is performed while image data having a density of 25% is printed with each of a nozzle group 101 including a defective nozzle 101*a* and a nozzle group 102. When the print apparatus is a serial type, the direction indicated by the arrow represents the main scanning direction of the printing heads. In the case of a line type, the direction of the arrow represents the direction in which a printing medium is conveyed In the ejection failure interpolation process in FIGS. 3A, 3B, and 3C, a method is implemented, in which only data of pixels to be printed by a defective nozzle 101*a* is extracted and added to data of pixels to be printed by a nozzle 102*a*. On the contrary, in the present embodiment, density is reduced not only for the pixels associated with the nozzle 101*a* but also for some of pixels associated with nozzles 101*b* and 101*c* which are adjacent to the nozzle 101*a*. Data in an amount equivalent to the density reduction is added to data of pixels associated with each of nozzles 102*b* and 102*c* which are adjacent to the nozzle 102*a*.

Figure 3B:
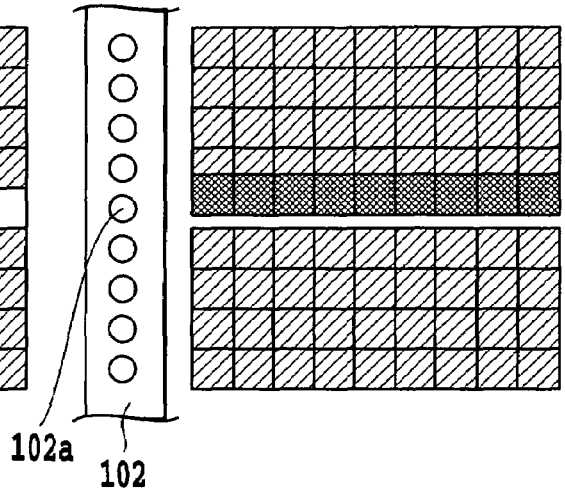
Figure 3C:
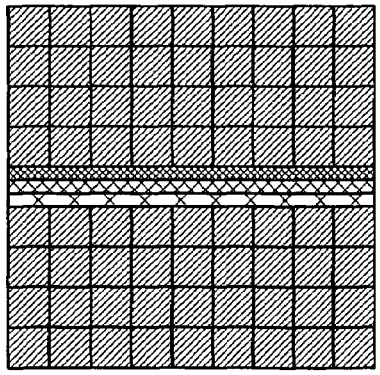

By performing such a process, even when there is a relative misalignment between the nozzle groups 101 and 102 for example, the influence of the misalignment of the nozzles between which interpolation is performed can be distributed over three lines. Thus, an extremely noticeable line as shown in FIG. 3B or 3C will not appear.

Figure 1A:
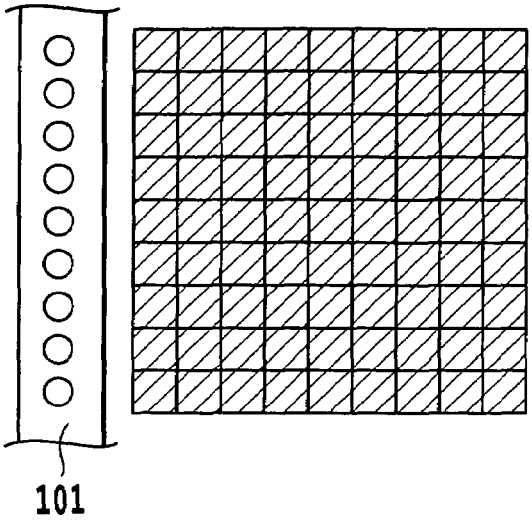
FIGS. 1A to 1C are illustrations showing a general state of printing in which an image is formed by two nozzle groups of different types.
Figure 1B:
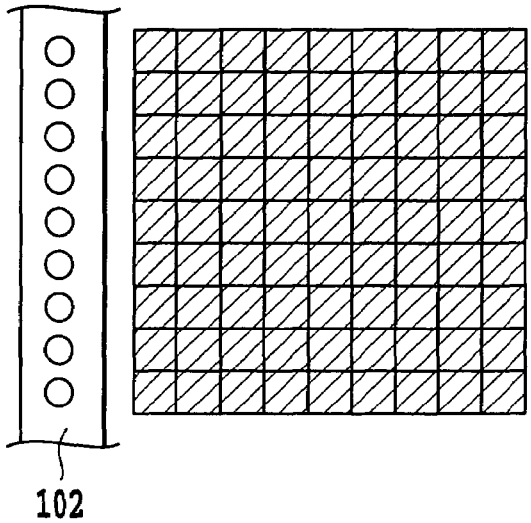
Figure 1C:
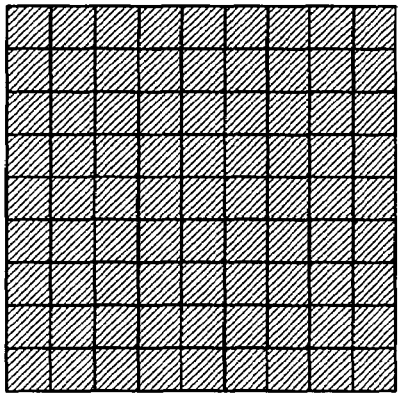
Figure 2A:
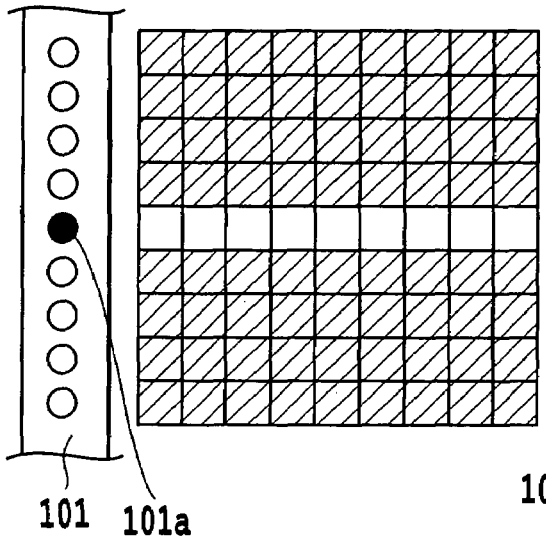
FIGS. 2A to 2C are illustrations showing a state of printing in which an ejection failure interpolation process is performed according to a method in the related art.
Figure 2B:
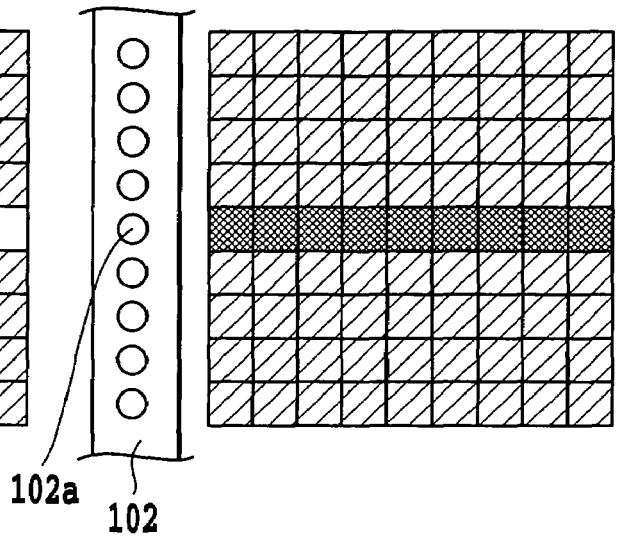
Figure 2C:
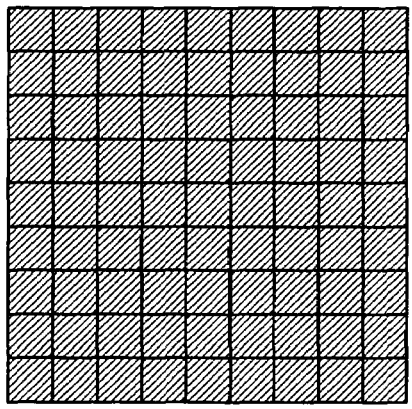

Even when the nozzle groups 101 and 102 print using inks in different colors, the inks in different colors are printed such that they are distributed over the three lines including the line associated with the nozzle 101*a* located in the middle. As a result, there is less possibility that one line having a color different from the color of the neighborhood thereof becomes striking than in a case wherein interpolation is performed using the method shown in FIGS. 2A, 2B, and 2C.

A study carried out by the inventor on an application of the present embodiment will now be specifically described along with results of the same.

Printing heads having 4096 nozzles arranged at a pitch to achieve 1200 dpi (1200 dots per inch) were used. The amount of ink droplets ejected by each of the nozzles was 4.5±0.5 pl (picoliters). A line type print apparatus having six printing heads as thus described was used, and printing was performed by supplying inks in three colors, i.e., cyan, magenta, and yellow, to respective pairs of the printing heads.

The compositions of the inks used were as follows.

(Prescription of Yellow Ink)
Glycerin: 5.0 parts by weight
Thiodiglycol: 5.0 parts by weight
Urea: 5.0 parts by weight
Isopropyl alcohol; 4.0 parts by weight
Dye: C. I. Direct Yellow 142; 2.0 parts by weight
Water: 79.0 parts by weight (Prescription of Magenta Ink)
Glycerin: 5.0 parts by weight
Thiodiglycol: 5.0 parts by weight
Urea; 5.0 parts by weight
Isopropyl alcohol: 4.0 parts by weight
Dye: C. I. Acid Red 289; 2.5 parts by weight
Water: 78.5 parts by weight (Prescription of Cyan Ink)
Glycerin: 5.0 parts by weight
Thiodiglycol: 5.0 parts by weight
Urea: 5.0 parts by weight
Isopropyl alcohol: 4.0 parts by weight
Dye: C. I. Direct Blue 199; 2.5 parts by weight
Water: 78.5 parts by weight PBPAPER A4 which is genuine plain paper manufactured by Canon Inc. was used as the printing medium.

Referring to the flow of the test, a pattern was first printed for each of the printing heads, the pattern allowing each of the nozzles to be checked on whether it had ejected ink or not and whether it had been in a good printing condition or not. Next, the printed pattern was read by an optical sensor at a resolution of 4800 dpi to extract nozzles which had not ejected ink or which were in an unpreferable state from each of the printing heads, and such nozzles were identified as defective nozzles.

The heads having defective nozzles thus identified and the positions of the nozzles were stored in the storage medium 34 of the print apparatus as defective nozzle information.

When an image was actually printed, the value of data for each pixel among input image data in each color was halved, and the value thus obtained was supplied to each of two printing heads which were to perform printing using the same ink. Specifically, the same data was printed by each of the printing heads at the same pixel in a region printed by the two printing heads.

Next, let us assume that the 1000-th nozzle of one of the two heads (hereinafter referred to as "first head") which were to perform printing, for example, in cyan had been identified as a defective nozzle. In this case, among data to be printed by the first head for cyan, data of the line associated with the 1000-th nozzle was deleted (or nullified). At the same time, the data value was added to the pixels of the line associated with the 1000-th nozzle of the second head.

Subsequently, the image data value of every fourth pixel of the image of each of the lines associated with the 999-th and 1001-th nozzles of the first head was halved (see FIG. 8A) At the same time, data equivalent to the reduction was added to the pixels of the lines associated with the 999-th and 1000-th nozzles of the second head.

Thereafter, each item of data was converted into a binary form, and printing was performed with the above-described inks and printing medium using the above-described ink jet print apparatus.

As a result, a high quality image could be obtained, which had less irregularities and in which the generation of white lines could be suppressed in comparison to an image which had not been subjected to interpolation for a defective nozzle. For comparison with methods in the related art, observation was carried out on printing performed using a second head whose 1000-th nozzle had been somewhat low in the accuracy of its ink landing position. In this case, it was confirmed again that the use of the present embodiment provided an output image having quality higher than that achievable with methods in the related art.

A description will now be made with reference to FIGS. 9A, 9B, and 9C on a case in which an image printed by a defective nozzle is interpolated using a nozzle which ejects an ink in a different color.

Figures 9A, 9B:
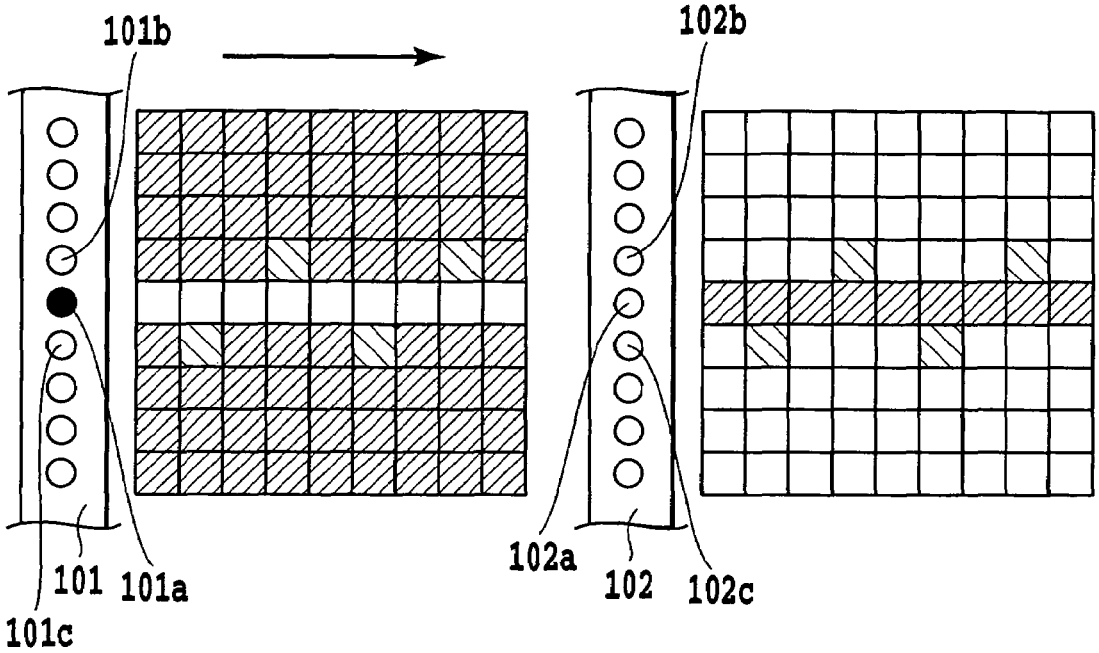
FIGS. 9A to 9C are illustrations for explaining the ejection failure interpolation process in the first embodiment of the invention.
Figure 9C:
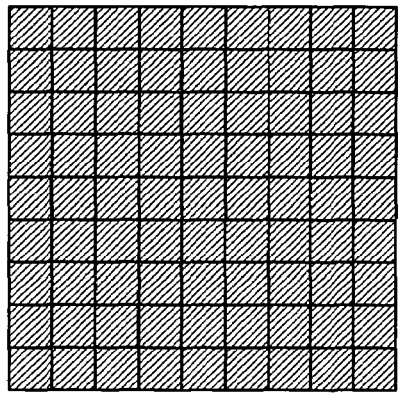

Referring to FIGS. 9A, 9B, and 9C, a nozzle group 101 performs printing using a cyan ink, and a nozzle group 102 performs printing using a magenta ink. FIG. 9A shows cyan data that is printed by the nozzle group 101, and FIG. 9B shows magenta data that is printed by the nozzle group 102 for ejection failure interpolation.

Although cyan should originally be printed in pixels associated with a defective nozzle 101*a*, the pixels are interpolated by a nozzle 102*a* using magenta in this case. Further, cyan data is reduced as shown in FIG. 9A for pixels associated with nozzles 101*b* and 101*c* which adjoin the nozzle 101*a* on both sides thereof. Data in an amount equivalent to the reduction is added as magenta data to pixels associated with nozzles 102*b* and 102*c*, respectively.

When interpolation is performed in such a manner, since color transition is smoothed in the vicinity of the line in a color different from the neighborhood thereof, there is a smaller possibility of a reduction in the uniformity of an image as a whole than in a case wherein only one line in a cyan image is converted into magenta.

Although the figures omit image information in magenta which should originally be present for simplicity, the present embodiment is effective even when information of magenta is included in actual image data. In this case, the magenta image information may be added to the data for interpolation shown in FIG. 9B.

When data in an amount equivalent to the reduction of cyan data is added to magenta, the amounts subtracted and added may be density values equivalent to each other, but the invention is not so limited. It is more preferable to take the luminance of each color into consideration and to adjust the amount of data added and the number and arrangement of pixels to be corrected such that an interpolated image will have substantially uniform luminance in the region of interest. Obviously, the present embodiment is effective also when an ink in a color other than magenta is used to correct printing in cyan.

Figure 10:
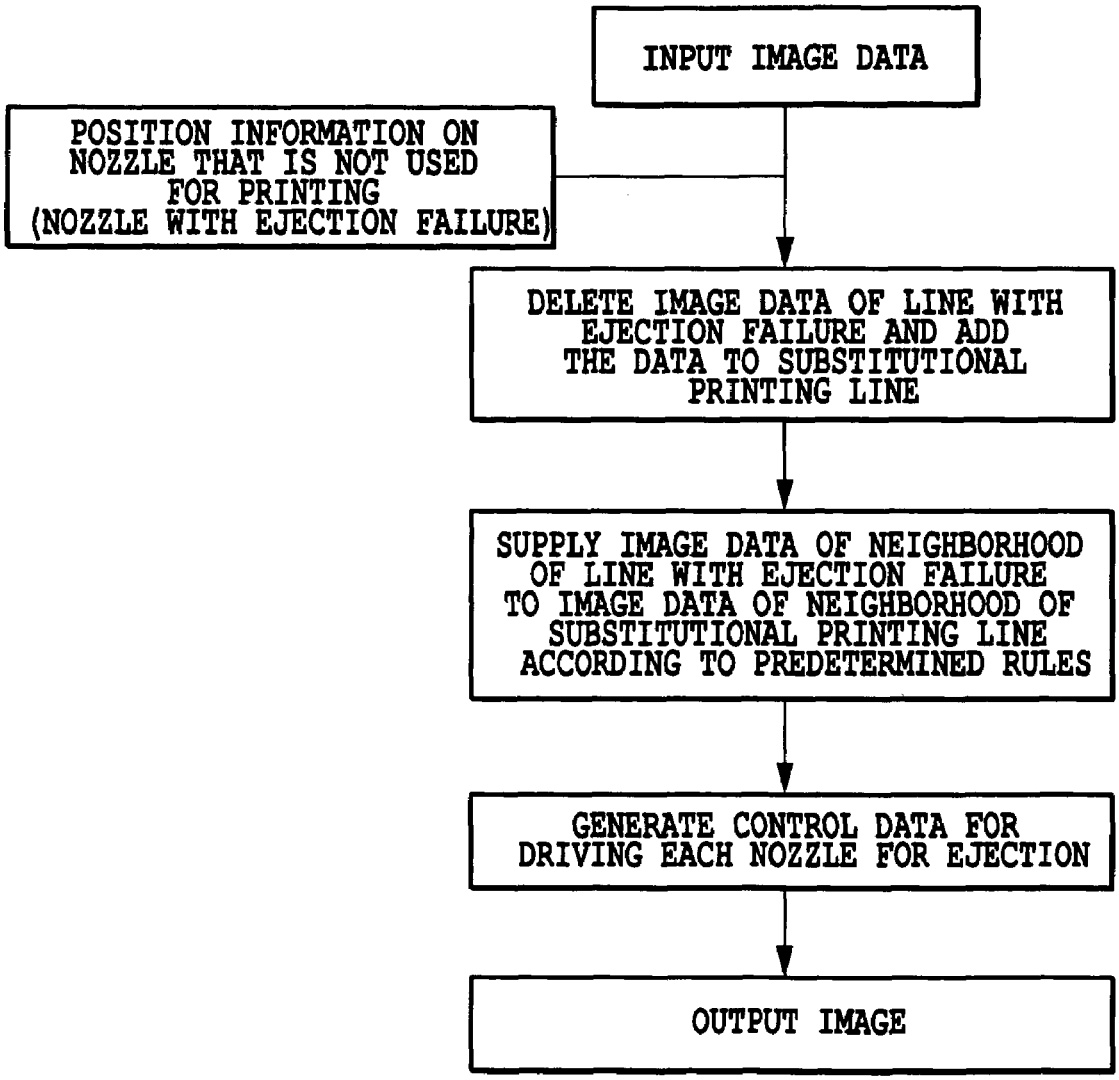
FIG. 10 is a block diagram for explaining steps of the ejection failure interpolation in the first embodiment of the invention.

FIG. 10 is a block diagram for explaining steps of the ejection failure interpolation in the present First, reference is made to information on defective nozzles, and pixels which should originally be printed by a defective nozzle are extracted as a line with an ejection failure from input image data Then, data of the pixels belonging to the line with an ejection failure is deleted and, at the same time, data in an equivalent amount is added to data of a line (substitutional line) which will be printed by a substitutional nozzle.

Further, data of pixels located in the vicinity of the line with an ejection failure is also supplied to data of pixels in the vicinity of the substitutional nozzle according to predetermined rules.

Thereafter, drive data for driving each nozzle for ejection is generated according to the data thus corrected to obtain an output image.

As described above, in the present embodiment, data to be printed by a defective nozzle is deleted; data in an equivalent amount is added to data to be printed by a predetermined substitutional nozzle; and, at the same time, data of predetermined pixels located in the vicinity of the defective nozzle is supplied to pixels in the vicinity of the substitutional nozzle. As a result, the state of printing in the vicinity of the defective nozzle is smoothed, and a line printed by the substitutional nozzle will not appear as local stripes.

Second Embodiment

A second embodiment of the invention will now be described.

Figure 11A:
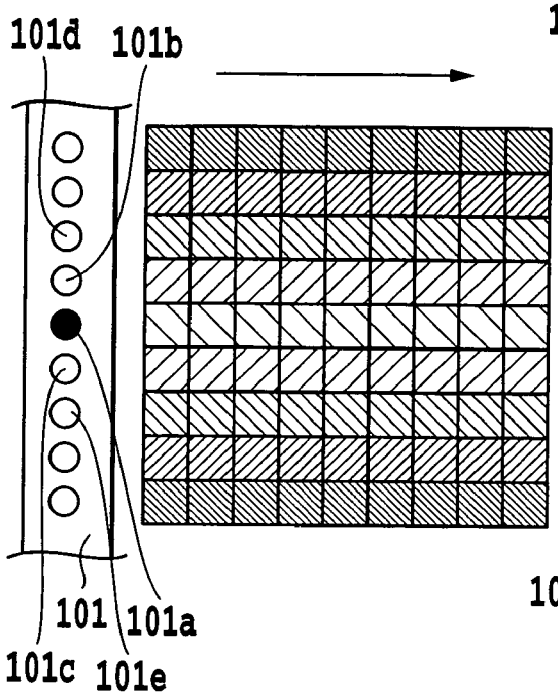
FIGS. 11A to 11C are illustrations for explaining an ejection failure interpolation process in a second embodiment of the invention.
Figure 11B:
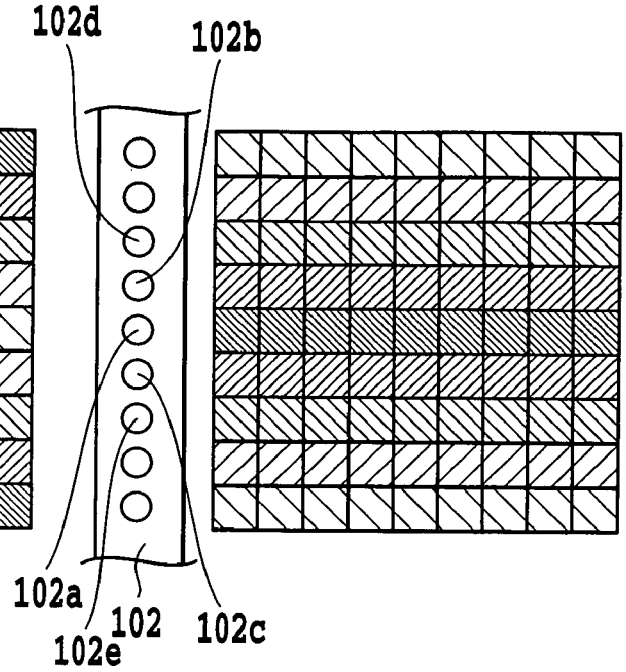
Figure 11C:
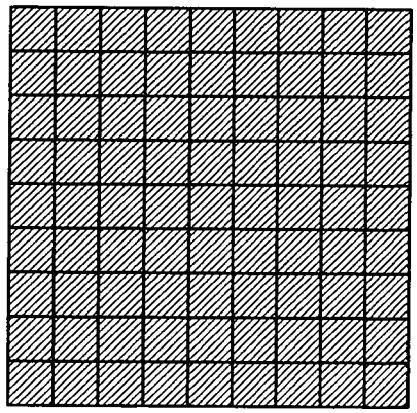

FIGS. 11A, 11B, and 11C are illustrations for explaining a method of interpolating an ejection failure in the present embodiment. FIGS. 11A, 11B, and 11C also show a state of printing achieved when an ejection failure interpolation process is performed while image data having a density of 25% is printed with each of a nozzle group 101 including a defective nozzle 101*a* and a nozzle group 102. When the print apparatus is a serial type, the direction indicated by the arrow represents the main scanning direction of the printing heads. In the case of a line type, the direction of the arrow represents the direction in which a printing medium is conveyed.

In the ejection failure interpolation in the first embodiment, data of pixels in predetermined positions among pixels printed by a defective nozzle 101*a* and nozzles on both sides of the same is reduced, and data in an equivalent amount is added to pixels associated with a substitutional nozzle 102*a* and nozzles 102*b* and 102*c* on both sides thereof. In the present embodiment, a range for correction in which an ejection failure interpolation process is performed is expanded to five nozzles. That is, data of pixels associated with nozzles 101*a* to 101*e* is corrected with nozzles 102*a* to 102*e*.

The method of correction is also different from the method of the first embodiment in which the positions of pixels used for correction are determined according to a predetermined pattern. A configuration is employed here, in which data of all pixels to be printed by the nozzles 101*a* to 101*e* is suppressed at "a rate determined in advance for each of the nozzles" and in which data values equivalent to the suppressed amounts are supplemented by the nozzles 102*a* to 102*e*.

Further, the "rate determined in advance for each of the nozzles" gradually decreases as the distance from the nozzle 101*a* in the middle that is a defective nozzle increases on both sides of the same. As a result, the corrected line is in a state as if it were subjected to unsharpness processing, and an effect similar to that in the first embodiment can be more preferably achieved.

FIG. 10 referred to in the first embodiment may be likewise used as a block diagram for explaining steps of the ejection failure interpolation process in the present embodiment.

A study carried out by the inventor on an application of the present embodiment will now be specifically described along with results of the same. The study was carried out using an ink jet print apparatus, printing heads, inks, and printing medium and a method of determining a defective nozzle similar to those in the study described in relation to the first embodiment.

When an image was actually printed, the value of data for each pixel among input image data in each color was halved, and the value thus obtained was supplied to each of two printing heads which were to perform printing using the same ink. Specifically, the same data was printed by each of the printing heads at the same pixel in a region printed by the two printing heads.

Next, let us assume that the 1000-th nozzle of one of the two heads (hereinafter referred to as "first head") which were to perform printing, for example, in cyan had been identified as a defective nozzle. In this case, among data to be printed by the first head for cyan, data of the line associated with the 1000-th nozzle was deleted (or nullified). At the same time, the data value was added to the pixels of the line associated with the 1000-th nozzle of the second head.

Data of pixels of lines associated with the 998-th to $1002^{nd}$ nozzles of the first head was subtracted by predetermined rates which were constant for the respective lines, and data in amounts equivalent to the reductions were added to pixels of lines associated with the 998-th to $1002^{nd}$ nozzles of the second head. The predetermined rates were such rates that data was subtracted at a rate that decreased as the distance from the 1000-th line of the first head where the 1000-th line had a minimum value or maximum rate (see FIGS. 11A, 11B, and 11C).

Thereafter, each item of data was converted into a binary form, and printing was performed with the above-described inks and printing medium using an ink jet print apparatus according to the present embodiment.

As a result, a high quality image could be obtained, which had less irregularities and in which the generation of white lines could be suppressed in comparison to an image which had not been subjected to interpolation for a defective nozzle. As a result of comparison with methods in the related art carried out similarly to the first embodiment, it was confirmed again that the use of the present embodiment provided an output image having quality higher than that achievable with methods in the related art.

Third Embodiment

A third embodiment of the invention will now be described. The above-described two embodiments have referred to methods for exchanging (subtracting and adding) data when image data is multi-valued. Referring to pixels in the vicinity of a defective nozzle, their original density values (data) were subtracted at a predetermined rate instead of nullifying them, and equivalent density values (data) were added to pixels in the vicinity of a substitutional nozzle. On the contrary, an ejection failure interpolation process according to the present embodiment is performed after image data is converted into binary information which clearing indicates whether ejection is performed or not. Therefore, data of pixels in the vicinity of a defective nozzle is also nullified, and the data itself is moved to pixels in the vicinity of a substitutional nozzle.

Figure 12A:
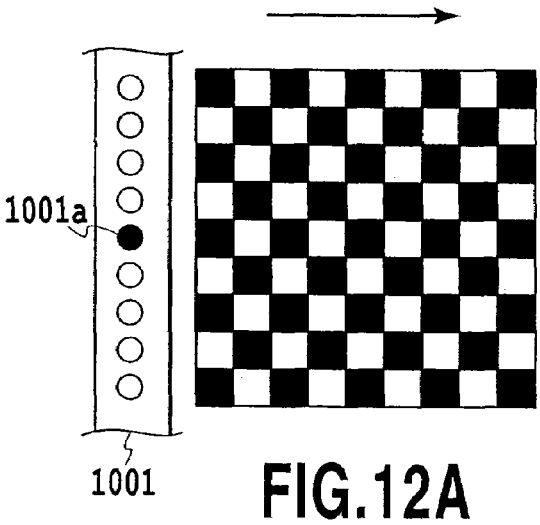
FIGS. 12A to 12D are illustrations for explaining an ejection failure interpolation process in a third embodiment of the invention.
Figure 12B:
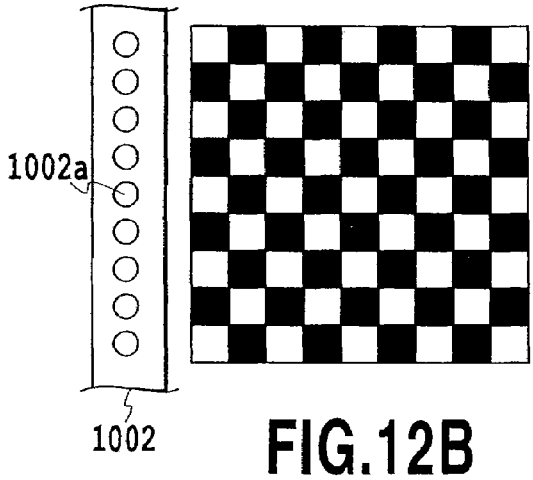

FIGS. 12A, 12B, 12C, and 12D are illustrations for explaining a method of correction in the present embodiment. FIG. 12A shows binary image data printed by a nozzle group 1001, and FIG. 12B shows binary image data printed by a nozzle group 1002. The solid black parts represent pixels in which printing takes place, and the white parts represent pixels in which no printing takes place.

Reference numeral 1001*a* represents a defective nozzle, and reference numeral 1002*a* represents a substitutional nozzle for interpolating an image to be printed by the defective nozzle 1001*a*.

Figure 12C:
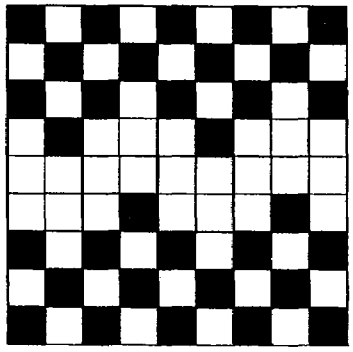
Figure 12D:
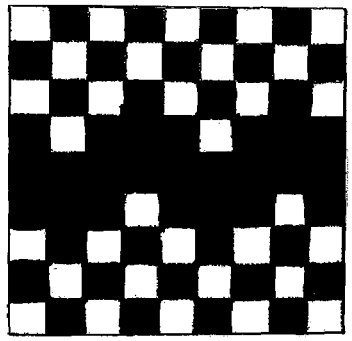

FIGS. 12C and 12D show image data printed by the nozzle groups 1001 and 1002, respectively, after the ejection failure interpolation process of the present embodiment is performed. As apparent from the figures, data for the defective nozzle 1001*a* is transferred as it is to the image data to be printed by the nozzle 1002*a*. Further, data to be printed in pixels in the vicinity of the nozzle 1001*a* is also transferred as it is to pixels to be printed by the nozzle group 1002.

Figure 13:
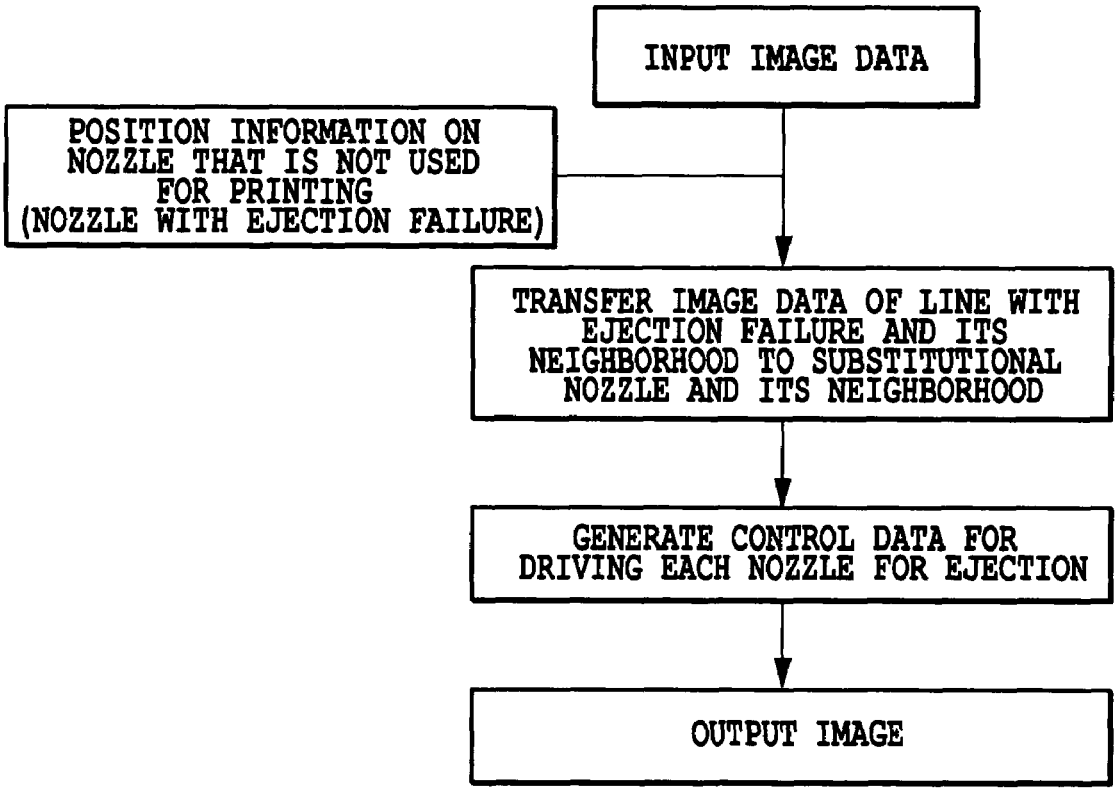
FIG. 13 is a block diagram for explaining a flow of processes for ejection failure interpolation in the third embodiment of the invention.

FIG. 13 is a block diagram for explaining a flow of processes for ejection failure interpolation in the present embodiment First, reference is made to information on defective nozzles, and pixels which should originally be printed by a defective nozzle are extracted as a line with an ejection failure from binary input image data. Then, data supplied to the pixels belonging to the line with an ejection failure is deleted and, at the same time, the data transferred to pixels associated with a line (substitutional line) which will be printed by a substitutional nozzle.

Further, data of predetermined pixels located in the vicinity of the line with an ejection failure is also transferred to pixels in the vicinity of the substitutional nozzle according to predetermined rules.

Thereafter, drive data for driving each nozzle for ejection is generated according to the newly created image data to obtain an output image.

The present embodiment is characterized in that the nozzle group 1001 including a defective nozzle and the nozzle group 1002 including a substitutional nozzle interpolate the positions of pixels to be printed by each other. As long as such a relationship is satisfied, the present embodiment is effective even when data at each pixel is binary data categorized as print data or non-print data or when the data includes density information having several levels to be represented by a plurality of stepwise ejection amounts.

A study carried out by the inventor on an application of the present embodiment will now be specifically described along with results of the same. The study was carried out using an ink jet print apparatus, printing heads, inks, and printing medium and a method of determining a defective nozzle similar to those in the study described in relation to the first and second embodiments.

When an image was actually printed, the value of data for each pixel among binary input image data in each color was first divided according to a predetermined thinning pattern. In this case, a checker pattern as shown in FIGS. 12A and 12B was used as a thinning mask For example, let us assume that the 1000-th nozzle of one of two printing heads (hereinafter referred to as "first head") had been identified as a defective nozzle. Thus, printing data was deleted from pixels of a line associated with the 1000-th nozzle and one half (50%) of pixels of lines associated with the 999-th and $1001^{st}$ nozzles among pixels to be printed by the first head. At the same time, the deleted data was moved to pixels associated with the 999-th and $1001^{st}$ nozzles of the second head.

Thereafter, printing was performed with the above-described inks and printing medium using an ink jet print apparatus according to the present embodiment.

As a result, a high quality image could be obtained, which had less irregularities and in which the generation of white lines could be suppressed in comparison to an image which had not been subjected to interpolation for a defective nozzle. As a result of comparison with methods in the related art carried out similarly to the above-described embodiments, it was confirmed again that the use of the present embodiment provided an output image having higher quality. In the present study, a nozzle that ejected ink to a position 2 μm away from an idealistic position was used as the 1000-th nozzle of the second head. 2 μm is a value that is substantially equivalent to 10% of the width of one pixel in the printing head of 1200 dpi that was used for the study.

Furthermore, a study was carried out on a method in which data was moved from about 25% of pixels in the vicinity of a defective nozzle. As a result, an effect substantially similar to the effect of moving 50% of the pixels as described above could be achieved. However, such an effect could not be achieved when data was moved from only about 5% of the pixels of interest.

Each of three embodiments of the invention has been described in a mode in which it can be applied to either a serial type or line type ink jet print apparatus.

In the above embodiments, a printing head of a type which has means (e.g., an electrothermal transducer or laser light) for generating thermal energy as energy to be used for causing ink ejection and which causes a change in the state of ink by the thermal energy is used and described as an ink jet printing system that is highly advantageous for print apparatus. Referring to typical configurations and principles of such a system, for example, it is preferable to adopt fundamental principles disclosed in the specifications of U.S. Pat. No. 4,723,129 and U.S. Pat. No. 4,740,796. While the system can be used in either of so-called on-demand type apparatus and continuous type apparatus, it is advantageous especially when used in an on-demand type apparatus. In an on-demand type apparatus, at least one drive signal is applied to an electrothermal transducer provided in association with a sheet or liquid channel containing a liquid (ink) to cause a rapid temperature rise exceeding nucleate boiling corresponding to information to be printed at the transducer. Thus, thermal energy is generated at the electrothermal transducer to cause film boiling on a thermally active surface of a printing head, which consequently makes it possible to form a bubble in the liquid (ink) in one-to-one correspondence with the drive signal. The liquid (ink) is ejected through an ejection hole as a result of the growth and expansion of the bubble to form at least one droplet. It is more preferable to provide the drive signal in the form of a pulse because a bubble grows and expands immediately and properly to allow the liquid (ink) to be ejected with high response.

A signal as disclosed in U.S. Pat. No. 4,463,359 or U.S. Pat. No. 4,345,262 is suitably used as the drive signal in the form of a pulse. Printing can be performed more preferably by adopting conditions disclosed in the specification of U.S. Pat. No. 4,313,124 which is an invention related to the rate of a temperature rise at a thermally active surface as described above.

Referring to the configuration of the printing heads, in addition to configurations in which ejection holes, liquid channels, and electrothermal transducers are combined as disclosed in the above-cited patent documents, the invention may comprise a configuration as disclosed in the specification of U.S. Pat. No. 4,558,333 or U.S. Pat. No. 4,459,600 in which a thermally active portion is provided in a bent area. In addition, the invention is advantageous when used in a configuration based on Japanese Patent Application Laid-open No. 59-123670(1984) disclosing a configuration in which a slit common to a plurality of electrothermal transducers serves as an ejecting portion of the electrothermal transducers or Japanese Patent Application Laid-open No. 59-138461(1984) disclosing a configuration in which an opening for absorbing a pressure wave originating from thermal energy is provided in association with an ejecting portion. The reason is that the invention allows printing to be performed with high reliability and efficiency regardless of the configuration of the printing heads.

The application of the invention is not limited to ink jet printing systems utilizing electrothermal transducers as described above. For example, in the case of a continuous type apparatus which continuously ejects ink droplets in the form of particles, the invention may be adapted to a charge control type or dispersion control type printing system. In the case of an on-demand type apparatus which ejects ink droplets as occasions demand, the invention advantageously works with a pressure control type printing system in which ink droplets are ejected from an orifice by mechanical vibrations of a piezoelectric oscillator.

In addition, in the case of a serial type print apparatus as described above, the printing heads used therein are not limited to the above-described configurations. The invention advantageously works with printing heads secured to the main body of a print apparatus, replaceable chip type heads which can be electrically connected with the main body of an apparatus and supplied with ink from the apparatus main body when attached to the apparatus main body, or cartridge type printing heads having ink tanks that are integrally provided with the heads themselves.

It is more preferable to add means for recovering ejection of printing heads or auxiliary means for preparatory purposes as a feature of a print apparatus according to the invention because it allows the effects of the invention to be achieved with improved stability. The ejection recovery means may be capping means, cleaning means, or pressurizing or absorbing means for the printing heads as already described in relation to the above embodiments. The auxiliary means for preparatory purposes may be electrothermal transducers, heating elements separate from the transducers, preparatory heating means for performing heating using a combination of those elements, or preparatory ejecting means for performing ejection for purposes other than printing.

Control programs for processing an image as described above are not required to be assembled in a print apparatus in advance, and they may be supplied from a printer driver at a host apparatus appropriately. Further, software or a program code of a printer driver for achieving the image processing functions described above may be supplied to a computer in an apparatus or system to which various devices including a printer are connected. In this case, operations of the devices according to the program code stored in the computer of the apparatus or system are included in the scope of the invention.

In this case, the program code itself achieves the novel features of the invention. Specifically, the scope of the invention includes the program code itself and means which supplies the program code to the computer through communication or a storage medium.

For example, the storage medium for supplying the program code may be a floppy disk, a CD-ROM, hard disk, optical disk, magneto-optical disk, CD-R, DVD, magnetic tape, non-volatile memory card, or ROM.

The scope of the invention includes not only the realization of the functions of the embodiments through execution of a program code read by a computer but also the realization of the functions of the above-described embodiments as a result of execution of part or whole of actual processes by an OS operating on the computer based on instructions from the program code.

Further, the scope of the invention includes a case in which a program code read from a storage medium is written in a memory provided on a feature expansion board inserted in a computer or provided in a feature expansion unit connected to the computer and in which a CPU provided on the feature expansion board or in the feature expansion unit thereafter performs part or whole of actual processes based on instructions from the program code to realize the functions of the embodiments.

Furthermore, an image processing system according to the invention may be a system having an image data supplying apparatus such as a computer, scanner, or digital camera and a printer as an image outputting terminal whether the system is for personal use or commercial or industrial use. For example, the system may alternatively be a copying machine which is a combination of a scanner and a printer, a facsimile machine which is a combination of a data transmitter/receiver and a printer, a word processor or electronic typewriter integrated with a printer, or a digital camera integrated with a printer.

As described above, according to the invention, a nozzle separate from a defective nozzle performs printing at not only pixels which are printed by the defective nozzle but also pixels in the neighborhood thereof at the same time. Therefore, even if there is relative misalignment between nozzle groups, irregularities of printing attributable to interpolation can be distributed to keep uniformity of an image as a whole.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet print apparatus for printing an image by ejecting ink from a printing head based on image data, the printing head having a plurality of nozzle groups, the plurality of nozzle groups being arrays of a plurality of nozzles for ejecting a liquid, the apparatus comprising:

correction means for correcting an image to be printed by a nozzle group including a nozzle in a defective ejecting condition so that the image is printed using at least one nozzle group not including a nozzle in a defective ejecting condition among the plurality of nozzle groups, wherein said correction means performs data processing so that the image data corresponding to the nozzle in the defective ejecting condition and a part of the image data corresponding to a nozzle adjacent to the nozzle in the defective ejecting condition are printed by the at least one nozzle group not including a nozzle in a defective ejecting condition, with the nozzle group including the nozzle in the defective ejecting condition printing some image data after said correction means performs the data processing, and wherein said correction means performs a subtracting process on multi-valued data of pixels to be printed by the nozzle in a defective ejecting condition and pixels in the vicinity of those pixels, simultaneously performs an adding process for adding an equivalent amount of data to multi-valued data of pixels to be printed by the at least one nozzle group not including the nozzle in a defective ejecting condition, and thereafter quantizes the multi-valued data of the pixels.

2. An ink jet print apparatus according to claim 1, wherein the amount subtracted by the subtracting process from the pixels printed by the nozzle in a defective ejecting condition is greater than the amount subtracted from the pixels in the vicinity of those pixels.

3. An ink jet print apparatus according to claim 1, wherein said correction means deletes data of pixels printed by the nozzle in a defective ejecting condition and pixels in the vicinity of those pixels and transfers the deleted data to pixels printed by the at least one nozzle group not including a nozzle in a defective ejecting condition, after performing a quantizing process on data of all of pixels at which the plurality of nozzle groups perform printing.

4. An ink jet print apparatus according to claim 1, wherein the plurality of nozzle groups eject ink in the same color.

5. An ink jet print apparatus according to claim 1, wherein the plurality of nozzle groups eject ink in different colors.

6. An ink jet print method in which an image is printed by ejecting ink from a plurality of nozzle groups based on image data, the plurality of nozzle groups being arrays of a plurality of nozzles for ejecting a liquid, the method comprising the step of:

correcting an image to be printed by a nozzle group including a nozzle in a defective ejecting condition so that the image is printed using at least one nozzle group not including a nozzle in a defective ejecting condition among the plurality of nozzle groups, wherein in the correcting step, data processing is performed so that the image data corresponding to the nozzle in the defective ejecting condition and a part of the image data corresponding to a nozzle adjacent to the nozzle in the defective ejecting condition are printed by the at least one nozzle group not including a nozzle in a defective ejecting condition, with the nozzle group including the nozzle in the defective ejecting condition printing some image data after the correcting step performs the data processing, and wherein in the correcting step a subtracting process is performed on multi-valued data of pixels to be printed by the nozzle in a defective ejecting condition and pixels in the vicinity of those pixels, an adding process is simultaneously performed for adding an equivalent amount of data to multi-valued data of pixels to be printed by the at least one nozzle group not including the nozzle in a defective ejecting condition, and thereafter the multi-valued data of the pixels is quantized.

7. A control program for causing a computer or a print apparatus to execute the ink jet print method according to claim 6.

8. A storage medium comprising a control program stored therein for causing a computer or a print apparatus to execute the ink jet print method according to claim 6.

* * * * *

UNITED STATES PATENT AND TRADEMARK OFFICE

CERTIFICATE OF CORRECTION

PATENT NO. : 7,316,464 B2
APPLICATION NO. : 10/864316
DATED : January 8, 2008
INVENTOR(S) : Shibata et al.

It is certified that error appears in the above-identified patent and that said Letters Patent is hereby corrected as shown below:

COLUMN 1:
Line 54, “generated” should read --generated.--.

COLUMN 2:
Line 33, “shows” should read --show--.

COLUMN 3:
Line 48, “comprising;” should read --comprising:--.

COLUMN 7:
Line 43, “storage medium 34” should read --storage medium 34.--.

COLUMN 8:
Line 3, “ejections” should read --ejection--.

COLUMN 9:
Line 67, “8A)” should read --8A).--.

COLUMN 10:
Line 62, “present” should read --present embodiment.--.
Line 66, “data” (first occurrence) should read --data.--.

COLUMN 13:
Line 21, “embodiment” should read --embodiment.--.
Line 58, “mask” should read --mask.--.

UNITED STATES PATENT AND TRADEMARK OFFICE

CERTIFICATE OF CORRECTION

PATENT NO. : 7,316,464 B2
APPLICATION NO. : 10/864316
DATED : January 8, 2008
INVENTOR(S) : Shibata et al.

It is certified that error appears in the above-identified patent and that said Letters Patent is hereby corrected as shown below:

COLUMN 17:
Line 21, "of" (second occurrence) should be deleted.

Signed and Sealed this

Tenth Day of March, 2009

JOHN DOLL
*Acting Director of the United States Patent and Trademark Office*